US005522710A

United States Patent [19]

Duarte

[11] Patent Number: 5,522,710

[45] Date of Patent: Jun. 4, 1996

[54] FLOWTHROUGH MANIFOLD ASSEMBLY FOR A LINEAR PUMP

[75] Inventor: George M. Duarte, Providence, R.I.

[73] Assignee: The United States of America as represented by the Secretary of the Navy, Washington, D.C.

[21] Appl. No.: 362,615

[22] Filed: Dec. 22, 1994

[51] Int. Cl.[6] ..... F04B 19/04

[52] U.S. Cl. ..... 417/392; 417/490; 222/388

[58] Field of Search ..... 222/388; 417/490, 417/392

[56] References Cited

U.S. PATENT DOCUMENTS

| | | | |
|---|---|---|---|
| 1,719,806 | 7/1929 | Jeffrey et al. | 222/388 X |
| 2,692,706 | 10/1954 | Wiksten | 222/388 X |
| 5,322,418 | 6/1994 | Comer | 417/490 X |

FOREIGN PATENT DOCUMENTS

| | | | |
|---|---|---|---|
| 1454224 | 11/1976 | United Kingdom | 417/490 |

*Primary Examiner*—Richard E. Gluck

*Attorney, Agent, or Firm*—Michael J. McGowan; James M. Kasischke; Prithvi C. Lall

[57] ABSTRACT

There is presented a manifold assembly for a linear pump, the assembly including a tubular manifold for attachment to an outlet portion of the pump, the manifold having therein a central bore extending lengthwise therethrough and aligned with the pump outlet, and a widthwise water inlet extending through a wall of the manifold to the central bore. The assembly further includes a sleeve slidably disposed in the central bore and adapted to be fixed to a piston in the pump. The sleeve is moveable in the manifold central bore in accordance with movement of the piston in the pump, to effect closure and opening of the water inlet to provide water pressure adjacent the piston as the piston reaches the end of its working stroke.

14 Claims, 3 Drawing Sheets

FLOWTHROUGH MANIFOLD ASSEMBLY FOR A LINEAR PUMP

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates to single stroke linear pumps and is directed more particularly to a manifold assembly for mounting on the outlet of such a pump and operative to eliminate water hammer from operation of the pump.

2. Description of the Prior Art

In the U.S. Navy, it is customary to use a single stroke linear pump to eject small devices from submarines. In such pumps, air pressure operates on one side of a piston to drive the piston to accelerate a fluid, typically seawater, behind the small device, causing ejection of the device from the submarine. At the conclusion of the stroke, a dashpot cone projecting from the piston enters the pump water outlet. The outlet and the dashpot cone are configured so as to decelerate the piston near the end of its stroke. Upon completion of the stroke, the cone is disposed in, and operates to close, the pump water outlet.

A problem develops at the end of the stroke in that the water being ejected from the pump does not slow down appreciably as the piston slows. At the end of the stroke, the water being pushed by the piston separates from the piston, moving ahead while the piston slows and stops, creating a low pressure zone adjacent to the piston. Typically, the pressure in the zone is below atmospheric. The ejecting seawater reacts to the low pressure by reversing its direction of flow back towards the low pressure zone. The reverse flowing water meets the piston causing an instant of high water pressure in the aforesaid zone. The pressure spike in the zone adjacent to the piston causes the phenomenon commonly referred to as water hammer. Inasmuch as water hammer is accompanied by a significant noise, it is a particular problem in a submarine environment wherein radiated noise can reveal a presence and/or a position.

Accordingly, there is a need for means to eliminate water hammer in a single stroke linear pump. So that pumps currently in use will not have to be replaced, it is preferable that any such means be in the form of an add-on mechanism which can be attached to current pumps.

SUMMARY OF THE INVENTION

An object of the invention is therefore to provide a flowthrough manifold assembly which is adapted to be fixed onto a linear pump and which acts to eliminate water hammer.

It is a further object that such mechanism be an addition to a pre-existing linear pump.

With the above and other objects in view, as will hereinafter appear, a feature of the present invention is the provision of a manifold assembly for a linear pump, the pump comprising a piston reciprocally movable in a pump chamber, the pump having an air conduit in a first wall of the chamber opposing a first side of the piston, and a water conduit in a second wall of the chamber opposing a second side of the piston. The piston includes a dashpot cone portion disposed centrally of, and projecting from, the second side of the piston, the dashpot cone portion being provided with tapered portions and being receivable by the water conduit to close the conduit upon completion of a working stroke of the piston. The manifold assembly comprises a tubular manifold for attachment to the pump, the manifold having a central bore extending therethrough and adapted to be aligned with the pump water conduit, and a water inlet extending through a wall of the manifold to the central bore. The manifold assembly further comprises a sleeve slidably disposed in the central bore and adapted to be fixed to the piston, the sleeve being moveable in the manifold central bore in accordance with movement of the piston in the pump, to effect closure and opening of the water inlet.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF SHE PREFERRED EMBODIMENT

Figure 1:
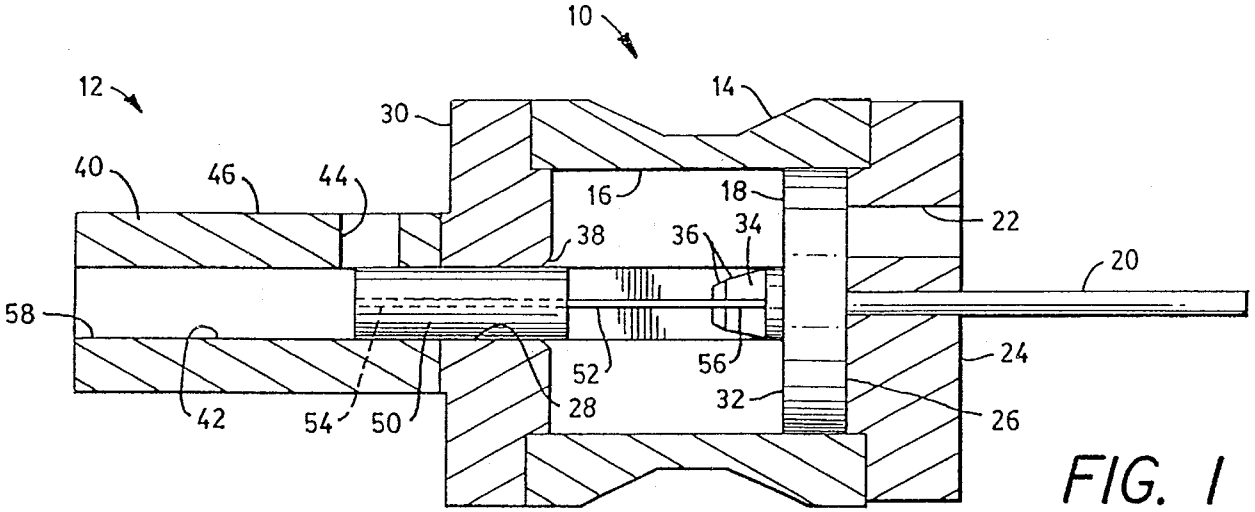
FIG. 1 is a sectional view of a flowthrough manifold assembly illustrative of an embodiment of the invention, the assembly shown connected to a linear pump.

Referring to FIG. 1, it will be seen that a pump 10, with which an illustrative manifold assembly 12 finds utility, comprises a housing 14 defining a pump chamber 16. A piston 18 mounted on a rod 20 is reciprocally movable in the chamber 16. The housing 14 is provided with an air conduit 22 in a first wall 24 of the housing, which is opposed to a first side 26 of piston 18. A water conduit 28 is provided in a second wall 30 of housing 14, which opposes a second side 32 of piston 18.

The piston 18 includes a dashpot cone portion 34 disposed centrally of, and projecting from, second side 32 of the piston. Dashpot cone portion 34 is provided with tapered portions 36 and is receivable by water conduit 28, which is provided with an annular bevel 38 to ease receipt of the cone tapered portions 36.

Manifold assembly 12, which is adapted for attachment to pump 10, includes a tubular manifold 40 having a central bore 42 extending therethrough and adapted to be aligned with water conduit 28 when manifold assembly 12 is fixed to pump 10. The manifold 40 further includes a radial water inlet 44 extending through a wall 46 of manifold 40 to central bore 42.

Figure 5:
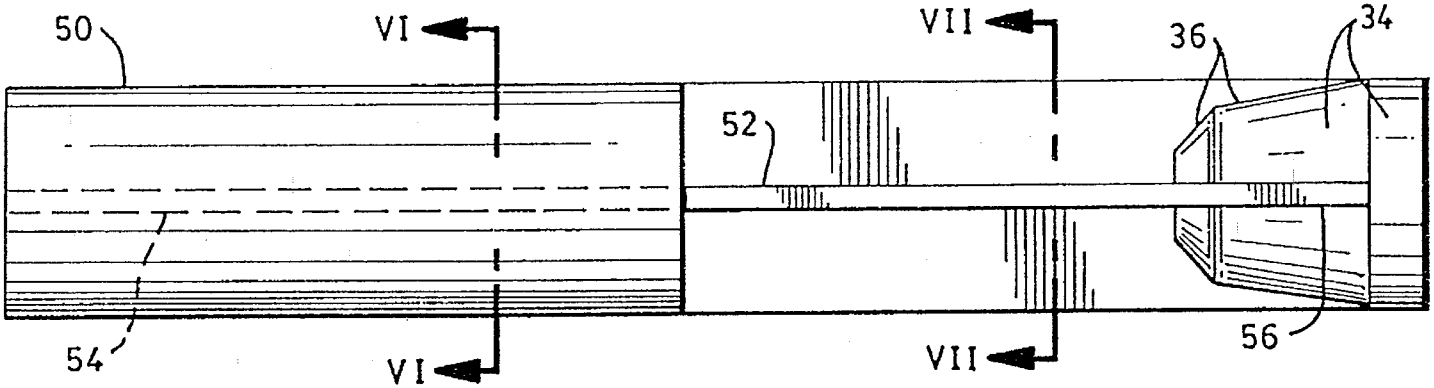
FIG. 5 is a side elevational view of a portion of the manifold assembly shown connected to a portion of the pump.
Figure 7:
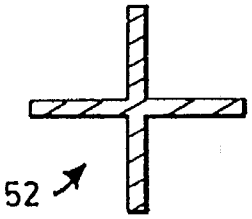
FIG.7 is a sectional view taken along line VII—VII of FIG. 5.
Figure 6:
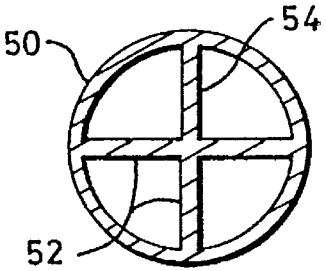
FIG. 6 is a sectional view taken along line VI—VI of FIG. 5.

Manifold assembly 12 further includes a sleeve 50 slidably disposed in central bore 42 and adapted to be fixed to piston 18 by a column 52, shown in detail in FIGS. 5–7, which at a first end 54 is connected to the interior of sleeve 50 and at a second end 56 is connected to piston 18, preferably to dashpot cone portion 34 of the piston. The column 52, as shown in FIGS. 5 and 7, preferably is of a cruciform configuration but can be of any configuration permitting the ready passage of water through sleeve 50. Thus, sleeve 50 moves in manifold central bore 42 in accordance with the movement of piston 18 in pump chamber 16.

In an at-rest position, shown in FIG. 1, piston 18 is furthest removed from manifold 40 and sleeve 50 is positioned such that water can enter manifold 40 by way of water inlet 44 and can enter pump chamber 16 by way of flow through sleeve 50, to fill pump chamber 16.

Figure 2:
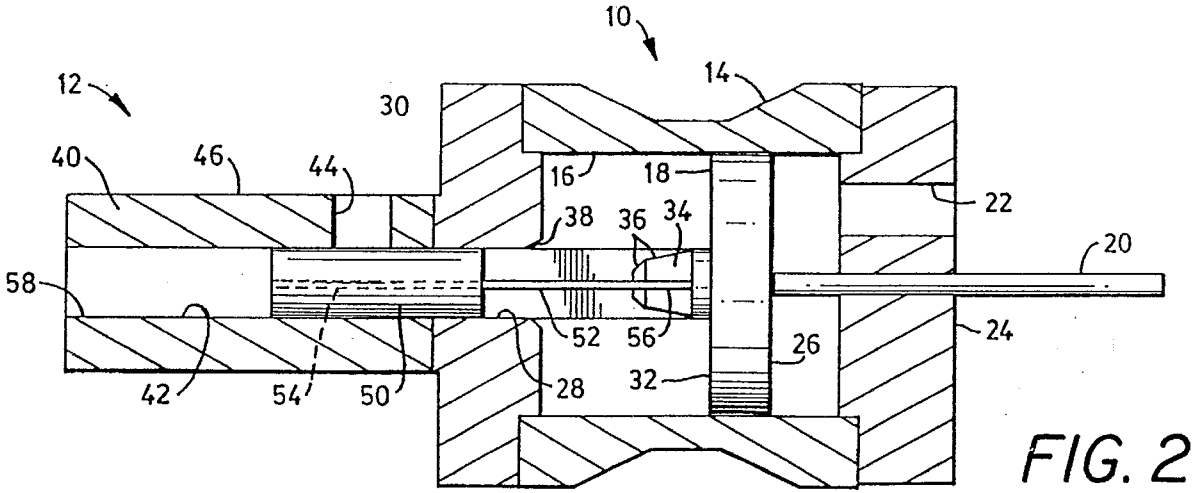
FIGS. 2–4 are similar to FIG. 1, but show pump and manifold components in different operating positions.

To effect a stroke of pump 10, pressurized air is admitted through air conduit 22, forcing piston 18 to move leftwardly, as viewed in FIG. 1. Although in this embodiment, piston 18 is actuated by pressurized air, piston 18 could also be actuated hydraulically or by actuation of rod 20. Referring to FIG. 2, it will be seen that sleeve 50, moving with piston 18, immediately closes off water inlet 44 to prevent back-flow of water out water inlet 44. Movement of piston 18 pushes water in pump chamber 16 and manifold 40 out a manifold discharge end 58. Manifold discharge end 58 is in communication with a launch assembly (not shown) which operates to eject a device from the submarine.

Figure 3:
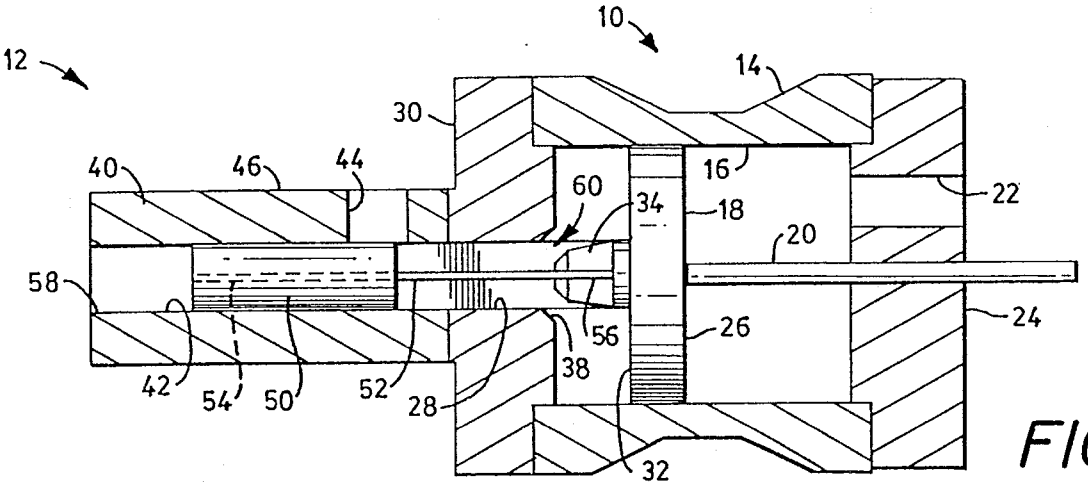
Figure 4:
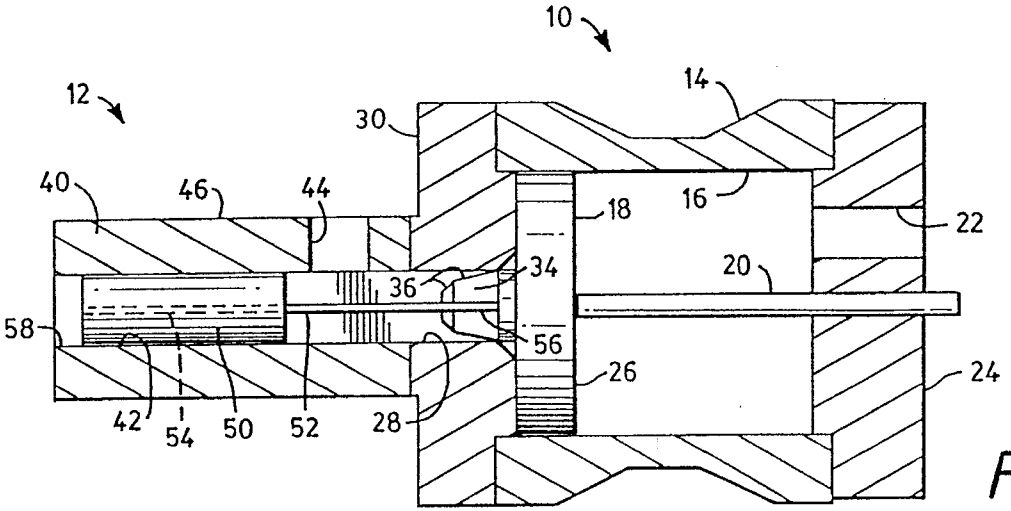

Referring to FIG. 3, it will be seen that as piston 18 nears the end of a working stroke, dashpot cone tapered portions 36 define in conjunction with water conduit bevel 38 a narrowing annular water discharge path 60. At the same time, sleeve 50 departs from a blocking position relative to water inlet 44, such that water flows into the area of water conduit 28. As sleeve 50 and piston 18 move leftwardly, as viewed in FIGS. 3 and 4, water inlet 44 becomes progressively more open, to permit a greater inrush of water to the zone adjacent piston second side 32. As piston dashpot cone portion 34 enters water conduit 28, water inlet 44 is fully open (FIG. 4). Thus, there is no zone of low pressure in the area adjacent piston 18 and no back-flow of water to fill such a zone and, therefore, no water hammer effect.

The piston 18 can then be drawn back to the position shown in FIG. 1, with water flowing into chamber 16 and manifold 40 through water inlet 44. A one-way valve in the launch assembly (not shown), or in a conduit leading thereto, prevents back-flow of substantial amounts of water through manifold discharge end 58.

Thus, there is provided a mechanism which is adapted for connection to linear pumps currently in use and which eliminates the problem of water hammer and the dangers associated therewith.

It is to be understood that the present invention is by no means limited to the particular construction herein disclosed and shown in the drawings, but also comprises any modification or equivalent within the scope of the claims.

What is claimed is:

1. A manifold assembly for a linear pump comprising a piston reciprocally movable in a pump chamber, said pump having an air conduit in a first wall of said chamber opposing a first side of said piston, and a water conduit in a second wall of said chamber opposing a second side of said piston, said piston having a dashpot cone portion projecting from said second side of said piston, said dashpot cone portion having tapered portions and being receivable by said water conduit to close said water conduit upon completion of a working stroke of said piston, said manifold assembly comprising:

a tubular manifold for attachment to said pump, said manifold having a central bore extending therethrough and adapted to be aligned with said pump water conduit, a water inlet extending through a wall of said manifold to said central bore; and a sleeve slidably disposed in said tubular manifold central bore and mechanically connected to said piston, said sleeve being movable in said manifold central bore in accordance with movement of said piston in said pump, to effect closure and opening of said water inlet during a working stroke of said piston, to provide water pressure adjacent said piston as said piston reaches the end of said working stroke.

2. The manifold assembly in accordance with claim 1 further comprising a column connected at a first end to said sleeve and at a second end to said piston.

3. The manifold assembly in accordance with claim 2 wherein said column is fixed at said first end thereof to the interior of said sleeve and at said second end thereof to said piston.

4. The manifold assembly in accordance with claim 3 wherein said column is of cruciform cross-section to allow water to flow through said column.

5. The manifold assembly in accordance with claim 4 wherein said column second end is fixed to said dashpot cone portion of said piston.

6. The manifold assembly in accordance with claim 2 wherein movement of said piston in said pump chamber in said working stroke positions said sleeve in said manifold bore such that in sequence said water inlet is partially open when said piston is farthest removed from said manifold, said water inlet is closed by said sleeve upon movement of said piston toward said manifold, and said water inlet is at least partially open when said piston nears and reaches a position in said chamber least removed from said manifold.

7. The manifold assembly in accordance with claim 6 wherein as said piston moves in said chamber near and to said position least removed from said manifold, and said dashpot portion enters said pump water conduit, said sleeve progressively opens said water inlet.

8. A manifold assembly for a linear pump, said assembly comprising:

a tubular manifold for attachment to said pump, said manifold having a central bore extending therethrough and adapted to be aligned axially with an outlet of said pump, a water inlet extending through a wall of said manifold to said central bore; and a flow-through sleeve slidably disposed in said tubular manifold central bore and connected by a flow-through column to a piston reciprocally moveable in a chamber in said pump, said sleeve being movable in said manifold central bore in accordance with movement of said piston in said pump, to effect closure and opening of said water inlet during a working stroke of said piston, to provide water pressure adjacent said piston as said piston reaches the end of its working stroke.

9. The manifold assembly in accordance with claim 8 further comprising a column connected at a first end to said sleeve and at a second end to said piston.

10. The manifold assembly in accordance with claim 9 wherein said column is fixed at said first end thereof to the interior of said sleeve and at said second end thereof to said piston.

11. A manifold assembly for a linear pump, said assembly comprising:

a tubular manifold for attachment to said pump, said manifold having a central bore extending therethrough and adapted to be aligned with a conduit of said pump, a water inlet extending through a wall of said manifold to said central bore; and a sleeve slidably disposed in said tubular manifold central bore and mechanically connected to a piston reciprocally moveable in a chamber in said pump, sleeve being movable in said manifold central bore in accordance with movement of said piston in said pump, to effect closure and opening of said water inlet during a working stroke of said piston, to provide water pressure adjacent said piston as said piston reaches the end of its working stroke;

a column being connected at a first end thereof to the interior of said sleeve and at a second end thereof said piston, said column being of cruciform cross-section to allow water to flow through said column.

12. The manifold assembly in accordance with claim 11 wherein a column second end is fixed to a dashpot cone portion of said piston.

13. The manifold assembly in accordance with claim 9 wherein movement of said piston in said pump chamber in said working stroke positions said sleeve in said manifold bore such that in sequence said water inlet is partially open When said piston is farthest removed from said manifold, said water inlet is closed by said sleeve upon movement of said piston toward said manifold, and said water inlet is at least partially open when said piston nears and reaches a position in said chamber least removed from said manifold.

14. The manifold assembly in accordance with claim 13 wherein as said piston moves in said chamber near and to said position least removed from said manifold, and said dashpot portion enters said pump water conduit, said sleeve progressively opens said water inlet.

* * * * *